US005537755A

United States Patent [19]

Kotitschke

[11] Patent Number: 5,537,755

[45] Date of Patent: Jul. 23, 1996

[54] DRYING SECTION FOR WEB-HANDLING APPARATUS

[75] Inventor: Gerhard Kotitschke, Steinheim, Germany

[73] Assignee: J. M. Voith GmbH, Germany

[21] Appl. No.: 296,240

[22] Filed: Aug. 25, 1994

[30] Foreign Application Priority Data

Aug. 25, 1993 [DE] Germany ..... 43 28 555.4

[51] Int. Cl.[6] ..... F26B 11/02

[52] U.S. Cl. ..... 34/117; 34/116; 34/114

[58] Field of Search ..... 34/114, 116, 117, 34/115

[56] References Cited

U.S. PATENT DOCUMENTS

| | | | |
|---|---|---|---|
| 4,022,366 | 5/1977 | Rooney . | |
| 4,359,827 | 11/1982 | Thomas | 34/116 |
| 4,669,198 | 6/1987 | Wedel | 34/114 |
| 4,850,121 | 7/1989 | Ely | 34/114 |
| 4,881,327 | 11/1989 | Hauser et al. | 34/114 |
| 4,891,891 | 1/1990 | Wedel | 34/114 |
| 4,905,380 | 3/1990 | Eskelinen et al. | 34/116 |
| 4,996,782 | 3/1991 | Eivola | 34/114 |
| 5,044,095 | 9/1991 | Eivola | 34/117 |
| 5,046,266 | 9/1991 | Autio | 34/117 |
| 5,214,861 | 6/1993 | Vuorinen | 34/114 |
| 5,241,761 | 9/1993 | Hauser | 34/114 |
| 5,249,372 | 10/1993 | Wedel | 34/114 |
| 5,321,899 | 6/1994 | Kade et al. | 34/114 |

FOREIGN PATENT DOCUMENTS

| | | |
|---|---|---|
| 0368937 | 8/1992 | European Pat. Off. . |
| 3941242 | 6/1991 | Germany . |
| 9109313 | 11/1991 | Germany . |
| 4328554 | 3/1994 | Germany . |

*Primary Examiner*—John M. Sollecito
*Assistant Examiner*—Steve Gravini
*Attorney, Agent, or Firm*—Ostrolenk, Faber, Gerb & Soffen

[57] ABSTRACT

A drying section for use in a papermaking machine has a two-felt drying group with an upper row of cylinders and an upper felt and with a lower row of cylinders and a lower felt. In each row of cylinders, two adjacent cylinders form a sub-group having a deflection suction roll disposed therebetween. A web to be dried passes alternately through the upper and lower sub-groups. Opposite each deflection suction roll of one row of cylinders lies a section of the felt path of the other row of cylinders, the space located therebetween being free from components to facilitate removal of paper broke.

26 Claims, 3 Drawing Sheets

DRYING SECTION FOR WEB-HANDLING APPARATUS

BACKGROUND OF THE INVENTION

1. Field of the Invention

The present invention relates to a drying section for drying a moving web in a web-handling apparatus, the drying section formed preferably as a part of a paper-making machine.

2. Description of the Prior Art

A drying section is described in German Patent DE 3,623,971 as having a number of drying cylinders disposed to form a two-felt drying group comprising an upper and a lower row of cylinders. In each row of cylinders, at least two adjacent cylinders form a sub-group. A deflection suction roll, which guides a felt, wire or like component (hereinafter referred to generally as a "felt"), together with a web to be dried, from the first to the second cylinder of the sub-group, is provided between the two cylinders. After passing through a sub-group (for example in the lower row of cylinders), the web runs over a so-called "web path" to a sub-group of the upper row of cylinders. These two sub-groups overlap one another so that the second cylinder of the lower sub-group lies beneath the first cylinder of the upper sub-group. After passing through the upper sub-group, the web again transfers downwardly to a further sub-group of the lower group of cylinders. It is also known from the above-noted German Patent to provide guide rolls for guiding the respective felts to one of the sub-groups and from there to the following sub-group (in the same row of cylinders). These guide rolls are disposed along the "web path" so that the web to be dried is guided a short distance by the felt, then runs freely for a short distance and then is conveyed for a short distance by the felt of the other row of cylinders to the following cylinder. The arrangement is also such that in the region of one deflection suction roll of one row of cylinders, there is located a predetermined section of the felt path of the other row of cylinders which is free from the web and touches two felt rolls. An air-blast box is also provided for blowing dry air onto the web to be dried at a point where the web runs together with the respective felt over the deflection suction roll. The air-blast box is disposed between the deflection suction roll and the above-mentioned predetermined section of the felt path.

On the one hand, the drying efficiency of the known drying section can be increased with the assistance of the air-blast boxes mentioned above. On the other hand, a problem occurs in the so-called pockets, which are very narrow, if the web to be dried tears. If the web to be dried tears, pieces of the torn-off web (the so-called "broke") remain hanging on the air-blast boxes. It is then normally necessary to stop the drying section to remove the broke. A further complication is that the air-blast boxes cannot be swivelled away (or can only be swivelled a short distance) from the deflection suction rollers because of the restricted spatial conditions.

An advantage of the drying section arrangement discussed above lies in that the number of the so-called "web paths" (between the upper and the lower row of cylinders) is roughly one half less than in the two-felt drying group normally used in a papermaking machines, in which, after each single cylinder, the web transfers from one row of cylinders to the next. The problem of web tears occurs therefore substantially less frequently than in conventional drying sections, but is in no way completely solved.

SUMMARY OF THE INVENTION

An object of the invention is to improve the drying section described in German Patent 3,623,971 so that the removal of broke is facilitated, and can take place without interrupting the operation of the drying section.

According to the invention, in such a known drying section, the space defined between the deflection suction roller and the predetermined section of the felt path is completely free from components. Thus, the air-blast boxes previously provided between each deflection suction roll and the adjacent section of the felt path are completely omitted. Therefore, in the pockets, there is no longer anything present to which broke could become attached. As a result, with the arrangement according to the invention, there is a tendency for broke to be transported further by the rotating cylinders and moving felts towards the end of the respective drying group, where it is discharged downwardly. This tendency is enhanced by the fact that the felt rolls are disposed in close proximity to or at a slight distance from the "web path". As known from the above-mentioned German Patent, this slight distance may even be equal to zero. In this case, the web can move freely for a short distance on the "web path", i.e. unsupported by one of the felts. Another possibility lies in that the two felts (i.e. the upper felt and the lower felt) overlap one another along the web path. In this case, the web moves "without free web draw" from the upper to the lower row of cylinders or vice versa.

A two-felt drying group having similar components is known from European Patent 0368937. However, there the felt is only guided over a single roll from one sub-group to the next, inside each row of cylinders. Therefore, the "web path" is free over its entire length from a lower to an upper cylinder or vice versa, i.e. completely unsupported by one of the felts. In fact, an attempt has been made to compensate for this disadvantage by an extremely small height spacing between the two rows of cylinders and thus, by very short "web paths". However, this results in very restricted space conditions.

Furthermore, when threading the so-called "strip", or tail, the known arrangement causes difficulties. A "strip" is a narrow edge strip of the paper web which is initially passed through the drying section when starting the paper making machine. After this strip has successfully passed through the drying section in a stable manner, the paper web is gradually introduced to its full width in a known manner. The threading of the strip should occur completely without the assistance of a rope guide which is normally provided for this purpose, thereby reducing the possibility of breakdown and accidents. Thanks to the at least partial guidance of the web by the felts on the so-called "web paths" (from the upper to the lower row of cylinders or vice versa) an automatic, i.e. rope-free, introduction of the strip, can be easily achieved, if necessary with the assistance of pneumatic strip guiding devices.

Other features and advantages of the present invention will become apparent from the following description of the invention which refers to the accompanying drawings.

BRIEF DESCRIPTION OF THE DRAWINGS

Further inventive features will become apparent from the following description of one embodiment of a drying section in accordance with the invention, and modifications thereof, in which.

DETAILED DESCRIPTION OF THE PREFERRED EMBODIMENTS

Figure 1:
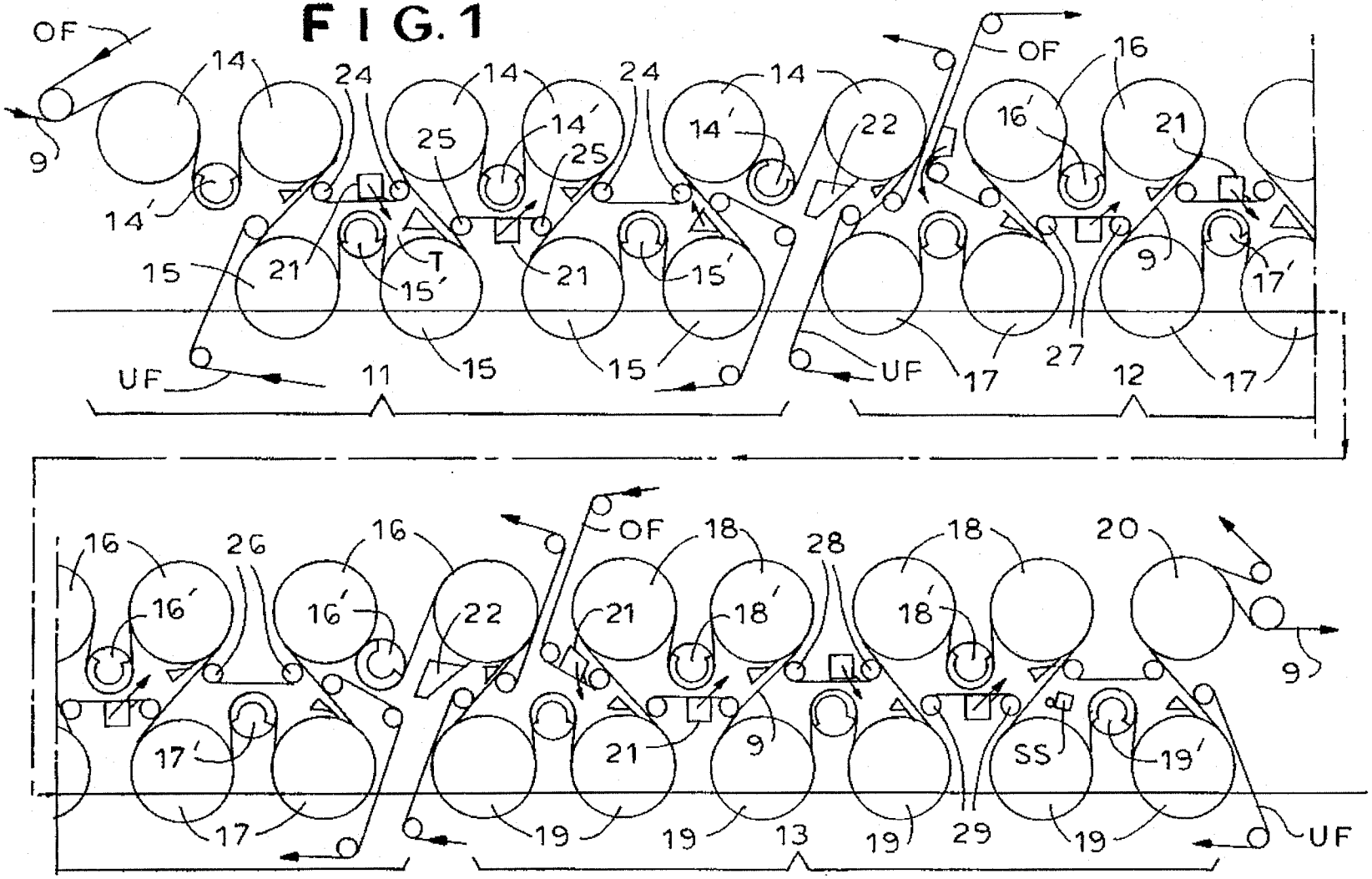
FIG. 1 is a schematic side view of one embodiment of the present invention including a drying section with several two-felt drying groups.

The drying section represented in FIG. 1 has three two-felt drying groups 11–13 disposed one after the other. Each of these drying groups includes an upper and a lower row of cylinders having an upper felt OF and a lower felt UF. In the upper row of cylinders of the first two-felt drying group 11, three cylinder pairs 14, hereinafter referred to as a "sub-group", are disposed behind one another. On the other hand, the lower row of cylinders of the first drying group 11 includes only two sub-groups 15 each having two cylinders. Deflection suction rolls 14' and 15', respectively, which come into direct contact with the respective felts (while the cylinders themselves come into direct contact with the paper web 9 to be dried) are provided between the two cylinders of each sub-group 14, 15. Respective pairs of felt rolls 24 are disposed between adjacent upper sub-groups 14 in order to guide the upper felt from one sub-group to the next. Two felt rolls 25 are also provided between the two lower sub-groups 15. Further felt rolls (without reference numbers) guide the felts in a known manner from the end of each row of cylinders back to its beginning.

The paper web 9 runs initially through the first upper sub-group 14 and then transfers to the first cylinder of the first lower sub-group 15. The paper web runs from the second cylinder of the first lower sub-group 15 back in the upward direction to the first cylinder of the second upper sub-group 14, etc.

In the exemplified embodiment shown in FIG. 1, the first cylinder of the first lower sub-group 15 lies exactly beneath the second cylinder of the first upper sub-group 14. In precisely the same manner, the first cylinder of the second upper sub-group 14 lies exactly above the second cylinder of the first lower sub-group 15, etc. However, the cylinders do not always have to lie exactly vertically above one another. The only important thing is that the upper and lower sub-groups overlap one another. It is also advantageous for the felt rolls (e.g. 24 and 25) to be disposed so that the felts OF and/or UF are conveyed a short distance with the paper web 9 on the "web path".

An air-blast box 21 can be provided between two felt rolls 24 lying between two adjacent sub-groups 14. This box 21 is therefore situated, in contrast with the known arrangement, inside the loop of the respective felt OF. The air-blast box 21 blows dry and preferably heated air into the interior of the pocket T to remove moisture from the pocket in a known manner. A doctor 22 is located beneath the second cylinder of the last upper sub-group 14 and beneath it a relatively wide gap is located between the two lower felts UF of the first and second drying groups 11, 12. Should the web tear, the broke runs substantially as in normal operation through the drying group and is downwardly discharged through the above-mentioned relatively wide gap.

The second drying group 12 is constructed in substantially exactly the same way as the first. There are again three upper sub-groups 16 each having two cylinders. The lower row of cylinders also includes three sub-groups 17 each having two cylinders. Thus, the first lower cylinder of the second drying group 12 lies beneath the last upper cylinder of the first drying group 11, so that here the paper web can transfer from the first to the second drying group. In exactly the same manner, the paper web—after passing through the entire second drying group 12—transfers from the second cylinder of the last upper sub-group 16 to the first cylinder of the first lower sub-group 19 of the third drying group 13. This has three lower sub-groups 19 each having two cylinders, while the upper row of cylinders has two sub-groups 18 and a single last cylinder 20, from which the dried paper web 9 runs off. It is obvious that the number of cylinders per drying group and/or the number of drying groups can be varied at random, depending on the requirements of the type of paper and/or the operating speed. Deflection suction rolls 16'–19', felt rolls 26–29 and air-blast boxes 21 are also provided in drying groups 12 and 13. A tail cutter provided in the end region of the last drying group 13 is designated by SS.

Figure 2:
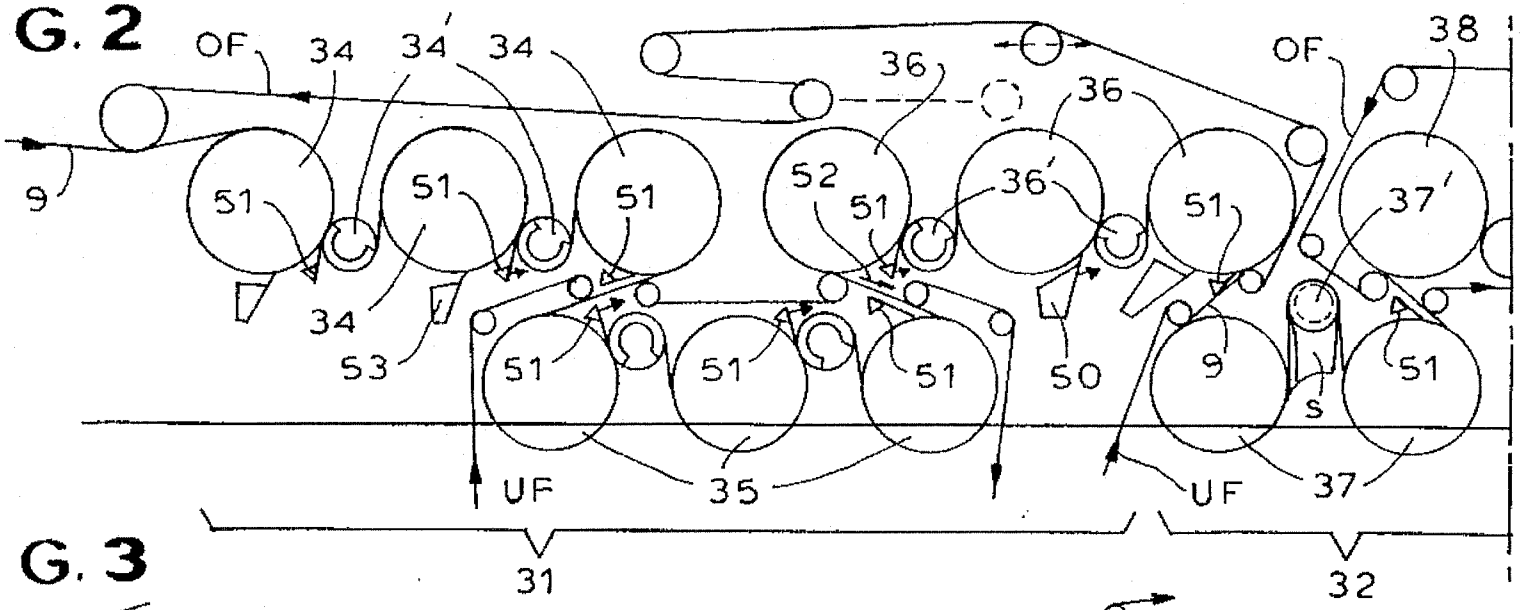
FIG. 2 is a schematic partial side view of a modification of an initial region of the drying section of FIG. 1.

FIG. 2 shows that a drying group can also be composed of sub-groups each having three cylinders. This is represented with the example of a first drying group 31, in which case the paper web 9 again initially passes through an upper sub-group 34, then transfers to a lower sub-group 35 and from there to a second upper sub-group 36. The sub-groups 34, 35, 36 mutually overlap. In the overlapping zones, a lower cylinder now however lies opposite a gap between two upper cylinders and vice versa. The following drying group 32 then has sub-groups 37, 38 each having two cylinders as in FIG. 1, which then lie vertically above one another in pairs. The first cylinder of the first lower sub-group 37 of the second drying group 32 also lies directly beneath the last cylinder of the second upper sub-group 36 of the first drying group 31.

Figure 3:
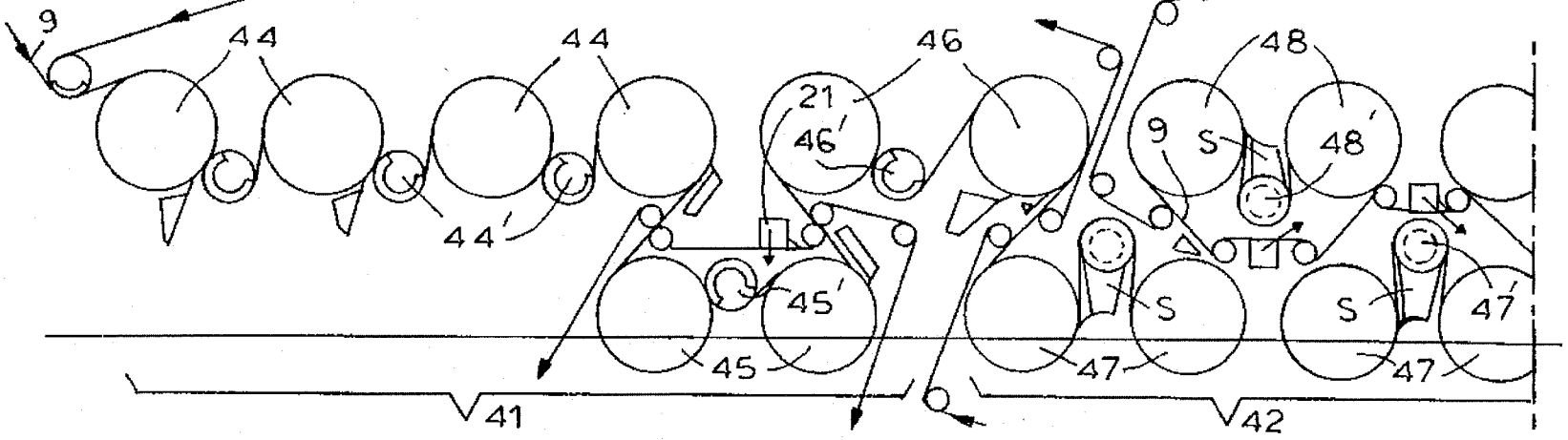
FIG. 3 is a schematic partial side view of a modification of an initial region of the drying section of FIG. 1.

The drying section shown in FIG. 3 differs from that in FIG. 1 firstly by the fact the lower row of cylinders of the first drying group 41 only has a single sub-group 45 with two cylinders. This sub-group lies beneath the fourth and fifth cylinders of the upper row of cylinders, which in turn has a total of six cylinders. Consequently, the first upper sub-group 44 has a total of four cylinders, the second sub-group 46 on the other hand has only two cylinders as before. This arrangement is advantageous if, with a paper web which is difficult to treat, there is the danger that tears to the web have to be expected relatively frequently right in the initial region of the drying section.

In both FIGS. 2 and 3, the deflection suction rolls 34', 36' and 44', 46', respectively, of the first drying group each have an inner suction box which limits (defines) a determined suction zone. Such suction rolls are preferably disposed non-symmetrically between two adjacent cylinders. The distance to the preceding cylinder is substantially less than to the following cylinder. This facilitates the safe detachment of the still damp web from the preceding cylinder. Another possibility is represented in the second drying group 32 and 42, respectively in FIGS. 2 and 3. In the second drying group 32 and 42, deflection suction rolls 37' and 47', 48' respectively, are provided. These deflection suction rolls 37' and 47', 48' respectively, do not have an internal suction box and the rotatable roll body of each of the deflection suction rolls does not have any suction connection either. The shell of these deflection suction rolls has circumferential grooves or is preferably perforated, as in the case of normal suction rolls. An external suction box S is provided at the sector of the roll periphery not covered by the felt. At the preceding cylinder, suction box S has a deflection bar for the air boundary layer advanced by the felt.

Figure 4:
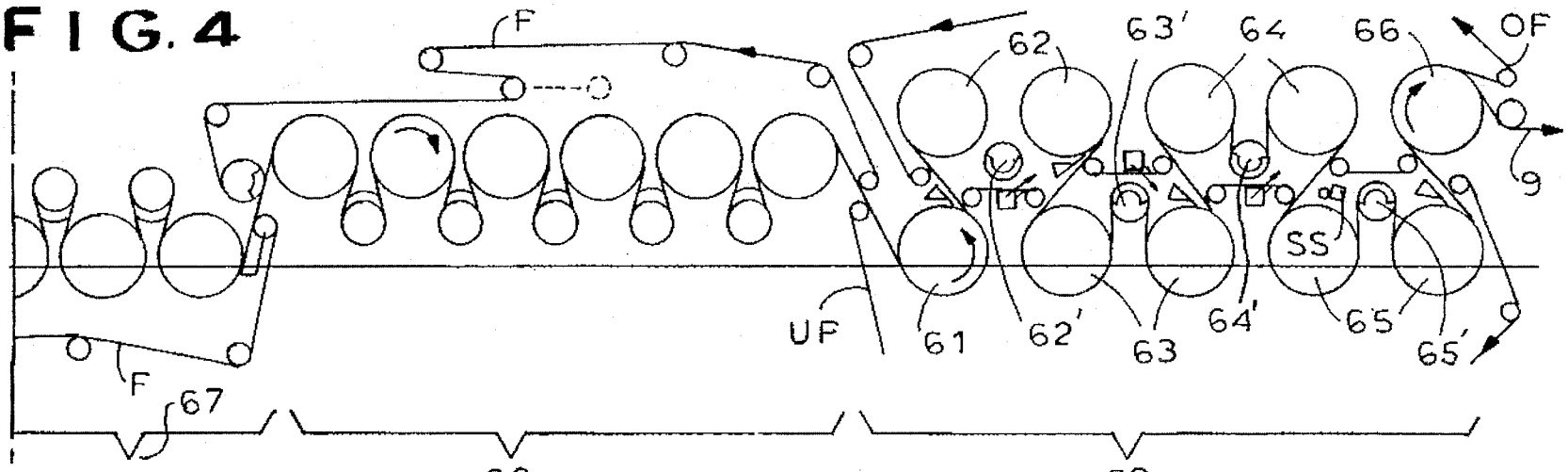
FIG. 4 is a schematic partial side view of a modification of a rear region of the drying section of FIG. 1.
Figure 5:
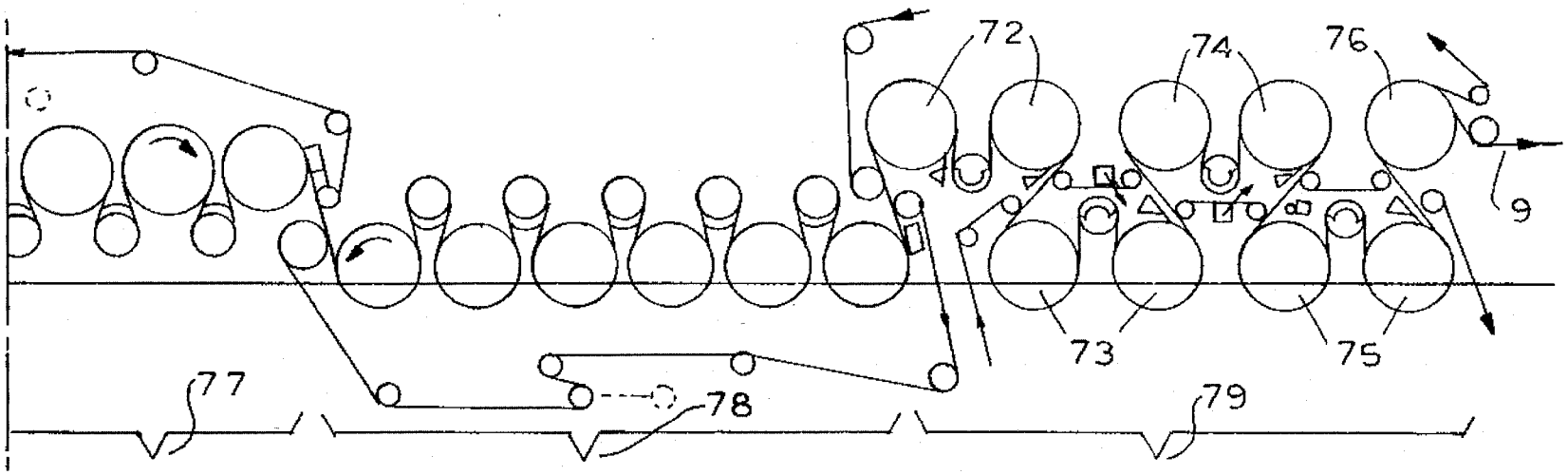
FIG. 5 is a schematic partial side view of a modification of a rear region of the drying section of FIG. 1.

FIGS. 4 and 5 show that a two-felt drying group according to the invention may be the last drying group 69 and 79, respectively, of a mixed drying section. This means that the first drying groups are constructed as single-felt drying groups. Each of these single-felt drying groups has a single endless felt, which runs together with the web to be dried alternately over cylinders and deflection suction rolls.

Several variants are possible. All single-felt drying groups can be felted at the top. Another possibility is shown in FIGS. 4 and 5, in which at least one of the single-felt drying groups 67, 68 and 77, 78 respectively, is felted at the bottom. In FIG. 4, this is the second to last single-felt drying group 67, while in FIG. 5, on the other hand, it is the last single-felt drying group 78, which is disposed immediately in front of the two-felt drying group 79. Accordingly, in FIG. 4, the paper web 9 runs from the last cylinder of the last single-felt drying group 68 initially to a single lower cylinder 61 of the two-felt drying group 69 and from this, the web 9 runs successively through sub-groups 62–65 (each having two cylinders with a deflection suction roll 62'–65' therebetween). At the end, a single upper cylinder 66 is provided. However, in FIG. 5, the web 9 runs upwardly from the last cylinder, felted at the bottom, of the last single-felt drying group 78 to a first cylinder of an upper sub-group 72 and after this, as in FIG. 4, via further sub-groups 73–75 each having two cylinders and finally over a single cylinder 76.

With reference to FIG. 2, it is now explained how the automatic, ropeless strip insertion into the two-felt drying group according to the invention can be performed. A machine-width doctor 50 (i.e. a doctor extending transversely across the entire machine width) is provided at one of the upper cylinders. The doctor 50 detaches the tip of the incoming strip from the cylinder and conveys it by means of an air-blast nozzle (symbolically represented by an arrow) to the following deflection suction roll 36'. In a known manner, this may have an edge suction zone for the strip, which has stronger suction during the strip insertion operation. In addition to a machine-width doctor 53, other cylinders have relatively short edge doctors 51 equipped with air blowing devices which extends just over the region of the strip, e.g. as described in German Patent DE 8914679. Further cylinders only have short edge doctors 51, i.e. without air blowing devices, as shown. In addition, a so-called pneumatic guide plate 52 can be provided, in particular on an upwardly leading "web path", e g. as described in German Patent DE9109313. A perforated belt conveyor, which is connected to a low pressure source, as described in U.S. Pat. No. 4,022,366, may be provided for the strip insertion instead of, or in addition to, air blowing devices.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section for drying a moving web, the drying section comprising:

(a) a plurality of drying cylinders for contacting the web, the drying cylinders disposed to form a two-felt drying group having an upper row and a lower row of drying cylinders, at least two adjacent drying cylinders of the upper row and two adjacent drying cylinders of the lower row of drying cylinders forming respective sub-groups;

(b) a deflection suction roller provided between two drying cylinders of each sub-group for guiding a felt together with the web in a path from one cylinder of one sub-group to an adjacent sub-group, each sub-group of a given row being located so as to overlap an adjacent sub-group of the other row to move the web over a web path from a sub-group of one of the upper and lower rows of cylinders to an overlapping sub-group of the other of the upper and lower rows of cylinders; and (c) a free section of a felt path of one of the upper and lower rows of drying cylinders is located near a deflection suction roller of the other of the upper and lower rows of drying cylinders, the web not being in contact with the felt at the free section of the felt path, the felt being in contact with two felt rolls;

wherein paper machine components are absent from a space defined between the deflection suction roller and the free section of the felt path.

2. A drying section according to claim 1, wherein a distance between the deflection suction roller and the free section of the felt path is less than a diameter of the deflection suction roller.

3. A drying section according to claim 1, further comprising an air-blast box for blowing air through the felt is provided inside each of a plurality of felt loops formed on a plurality of felt paths which are positioned opposite to a deflection suction roll.

4. A drying section according to claim 1, wherein at least two two-felt drying groups follow one another.

5. A drying section according to claim 1, wherein at least one additional single-felt drying group is provided, in which a single endless felt and the web are caused to run together over the plurality of drying cylinders and over the deflection suction rollers.

6. A drying section according to claim 4, wherein a separating point is disposed between the lower felts of two adjacent drying groups and beneath a central region of an upper sub-group.

7. A drying section according to claim 6, wherein an increased horizontal spacing is provided inside said upper sub-group between two adjacent cylinders, as compared to adjacent cylinders located elsewhere in the drying section.

8. A drying section according to claim 1, wherein two cylinders are provided in each sub-group, and wherein the lower and upper cylinders are disposed in pairs to be substantially vertically aligned above one another.

9. A drying section according to claim 1, wherein three cylinders are provided in each sub-group and wherein each of the lower cylinders is disposed beneath a space between two of the upper cylinders.

10. A drying section according to claim 1, wherein the two-felt drying group is a first drying group of the drying section, and wherein a first sub-group of the two-felt drying group is felted on a top portion thereof.

11. A drying section according to claim 10, wherein the first sub-group has a larger number of cylinders than adjacent sub-groups.

12. A drying section according to claim 1, wherein at least one part of the deflection suction rolls has an inner stationary suction box.

13. A drying section according to claim 12, wherein a smaller distance is provided between a deflection suction roll and a preceding drying cylinder than between the deflection suction roll and a following drying cylinder.

14. A drying section according to claim 1, wherein at least one of the deflection suction rolls has a roll body free from suction connections and an external suction box.

15. A drying section according to claim 14, wherein the cylinder preceding each external suction box has a deflection bar for an air boundary layer advanced by the felt.

16. A drying section according to claim 1, further comprising an automatic strip guiding device.

17. A drying section for drying a moving web, the drying section comprising:

a) a plurality of drying cylinders;

b) a plurality of felt rollers;

c) at least one felt for being moved along a felt path by the felt rollers to contact the web as the web contacts the plurality of drying cylinders, the felt path having a free portion where the at least one felt does not contact the web;

d) a deflection suction roller disposed between adjacent drying cylinders and the plurality of felt rollers; wherein an open space is defined between the deflection suction roller and the free portion of the felt path such that none of a plurality of components forming the drying section is located in the open space.

18. The drying section of claim 17, further comprising a blower for blowing air onto the felt at the free portion of the felt.

19. The drying section of claim 18, wherein the blower is located between the felt rollers and in the open space.

20. The drying section of claim 18, wherein the felt is formed in a loop which surrounds the felt rollers and at least one of the drying cylinders and the blower is located inside of the loop.

21. A drying section for drying a web, the drying section comprising:

a) an upper and lower tier of drying cylinders for moving a web along a web path;

b) an upper felt moving along an upper felt path for guiding the web over the upper tier of drying cylinders along a portion of the web path;

c) a lower felt moving along a lower felt path for guiding the web over the lower tier of drying cylinders along a portion of the web path, at least one portion of one of the upper and lower felt paths defining a free portion which is not coincident with the web path and along which the web is not supported by one of the upper felt and the lower felt;

d) a deflection suction roll located between an adjacent pair of drying cylinders of one of the upper and lower tiers for guiding the one of the upper and lower felts together with the web along a section of the web path extending from one of the adjacent drying cylinders to the other, the deflection suction roll being spaced from but opposed to the free portion of the one of the upper and lower felts so as to define a space therebetween, the space being devoid of other components of said dryer; and e) an air blast box located above the free portion of the one of the upper and lower felt paths and for blowing air onto the one of the upper and lower felts.

22. The drying section of claim 21, wherein a distance between the deflection suction roll and the free section of the one of the upper and lower felt paths is less than a diameter of the deflection suction roll.

23. The drying section of claim 21, wherein the one of the upper and lower felt paths forms a loop and the air blast box is located inside of the loop.

24. The drying section of claim 21, wherein the air blast box is spaced away from the web path by an amount sufficient to prevent a torn portion of the web from contacting the air blast box when the web tears.

25. The drying section of claim 21, wherein the upper and lower tiers of drying cylinders and the upper and lower felts cooperate to guide a torn portion of the web resulting from tearing of the web through the upper and lower tiers of drying cylinders to an exit and to prevent the torn portion of the web from contacting the air blast box.

26. A drying section for drying a moving web, the drying section comprising:

(a) a plurality of drying cylinders for contacting the web, the drying cylinders disposed to form a two-felt drying group having an upper row and a lower row of drying cylinders, at least two adjacent drying cylinders of the upper row and two adjacent drying cylinders of the lower row of drying cylinders forming respective sub-groups;

(b) a deflection suction roller provided between two drying cylinders of each sub-group for guiding a felt together with the web in a path from one cylinder of one sub-group to an adjacent sub-group, each sub-group of a given row being located so as to overlap an adjacent sub-group of the other row to move the web over a web path from a sub-group of one of the upper and lower rows of cylinders to an overlapping sub-group of the other of the upper and lower rows of cylinders; and (c) a free section of a felt path of one of the upper and lower rows of drying cylinders is located near a deflection suction roller of the other of the upper and lower rows of drying cylinders, the web not being in contact with the felt at the free section of the felt path, the felt being in contact with two felt rolls, the felt rolls being disposed in close proximity to said web path;

wherein paper machine components are absent from a space defined between the deflection suction roller and the free section of the felt path is completely free from components.

* * * * *